US009511003B2

(12) United States Patent
Medrano

(10) Patent No.: US 9,511,003 B2
(45) Date of Patent: Dec. 6, 2016

(54) MEDICATION ADHERENCE AND CONTAINER SYSTEM FOR UNDER AND OVERDOSE SAFEGUARD

(71) Applicant: Rafael A. Medrano, Houston, TX (US)

(72) Inventor: Rafael A. Medrano, Houston, TX (US)

( * ) Notice: Subject to any disclaimer, the term of this patent is extended or adjusted under 35 U.S.C. 154(b) by 58 days.

(21) Appl. No.: 14/537,757

(22) Filed: Nov. 10, 2014

(65) Prior Publication Data

US 2015/0129602 A1 May 14, 2015

Related U.S. Application Data

(60) Provisional application No. 61/902,448, filed on Nov. 11, 2013.

(51) Int. Cl.
*A61J 7/04* (2006.01)

(52) U.S. Cl.
CPC ..... *A61J 7/0409* (2013.01); *A61J 7/0418* (2015.05); *A61J 1/1425* (2015.05)

(58) Field of Classification Search
CPC ..... B65D 83/04; B65D 81/3216
See application file for complete search history.

(56) References Cited

U.S. PATENT DOCUMENTS 3,433,378 A 3/1969 Ross
3,741,383 A * 6/1973 Wittwer ..... B65D 81/3216 206/219
4,133,445 A * 1/1979 Mandelbaum ..... B65D 21/0204 206/504
4,361,408 A 11/1982 Wirtschafter
4,611,924 A 9/1986 Stasin
4,616,752 A * 10/1986 Ridgley ..... A61J 1/03 206/521
5,165,546 A 11/1992 Jaeger et al.
5,233,571 A 8/1993 Wirtschafter
5,313,439 A 5/1994 Albeck
5,720,392 A 2/1998 Price
5,751,661 A 5/1998 Walters
5,950,819 A 9/1999 Sellars
6,145,697 A * 11/2000 Gudish ..... A61J 7/0409 221/3
7,311,205 B2 12/2007 Adler et al.
(Continued)

*Primary Examiner* — Gene Crawford
*Assistant Examiner* — Ayodeji Ojofeitimi
(74) *Attorney, Agent, or Firm* — Parks & Associates, PC

(57) ABSTRACT

A medication adherence and container system for informing a patient when it is time to and not to take medication; for storing medicine information sheets with the medicine containers; and holding the medicine containers in arranged clusters, having containers and caps which interact between each other as switches with the electrical circuits provided. The electrical circuits have a timing device which can be set for a predetermined elapsed time and provides a continuous signal, such as a colored light, during the running of said predetermined time to indicate "not to take medication" and then provides a different signal, such as a different colored light, when the predetermined time has lapsed to indicate "take medication" and continues that signal until being reset upon breaking the electrical circuit between cap and container and restarting the timing device on closing the circuit between cap and container for measuring another predetermined elapsed time.

9 Claims, 7 Drawing Sheets

(56) References Cited

U.S. PATENT DOCUMENTS

| | | | | |
|---|---|---|---|---|
| 7,347,341 | B2 * | 3/2008 | Burggraf | A61J 7/0084 221/197 |
| 7,587,259 | B2 * | 9/2009 | Berg | A61J 7/0084 221/124 |
| 8,056,724 | B2 | 11/2011 | Estep | |
| 8,391,104 | B2 * | 3/2013 | de la Huerga | A61J 1/035 206/459.5 |
| 8,666,543 | B2 * | 3/2014 | MacVittie | B65D 83/0409 221/241 |
| 2003/0156724 | A1 | 8/2003 | Mariano et al. | |
| 2004/0045856 | A1 | 3/2004 | Rhoades | |
| 2009/0134181 | A1 | 5/2009 | Wachman et al. | |
| 2012/0168331 | A1 | 7/2012 | Tagger | |
| 2012/0199650 | A1 * | 8/2012 | Horst | G07F 17/0092 235/375 |

* cited by examiner

MEDICATION ADHERENCE AND CONTAINER SYSTEM FOR UNDER AND OVERDOSE SAFEGUARD

RELATED APPLICATION

This application is related to and claims priority from U.S. Provisional Application No. 61/902,448 entitled "Bottle-Cap Medication Reminder and Overdose Safeguard," filed 11 Nov. 2013, the entire contents of which are hereby fully incorporated herein by reference for all purposes.

BACKGROUND OF THE INVENTION

1. Field of the Invention

This invention relates to a medicine container system using electrical circuits having a timing device which can be set for predetermined elapsed times and provides continuous signals for informing a patient when it is time to take and not to take medication in a simple error free way without the patient having to read clock faces, or digital read outs or remember times or time settings or set timers and for storing information sheets about the medicine and its side effects with the container or in compartments proximate to the normal medicine container and for holding said medicine container or containers in an arranged cluster to consolidate all the medications a person is taking into a single confined arrangement with access to the medications by normal medicine cap removal from each medicine container.

2. Background of the Invention

Medication noncompliance is a major problem in healthcare. According to a report from the Centers of Disease Control and Prevention (CDC) one in two patients neglect and do not take their medication as prescribed, and six out of ten forget, at one point or another, they have already taken a medication and swallow an extra dose sending them to an emergency room for treatment or clearly worsening their current condition.

As a result, accidental prescription drug overdoses have turned into a crisis that is steadily worsening and has become the second leading cause of unintentional injury and death in the United States. Therefore, there exists an undeniable urgency to prevent these overdose injuries and fatalities caused primarily by accidental drug overdose and the misuse of hazardous prescription drugs, in part, because patients do not have sufficient knowledge about the drugs and their side effects with their drug containers and cannot remember when to take their medications or because they forget they have already taken a medication and unknowingly swallow an additional dosage of that medication. Further compounding the unintentional overdose confusion is that patients have many medications to take and they are not all kept in one place in an arranged orderly fashion or do not have mechanisms for indicating the time or time intervals for when to take them or when they were last taken.

Many devices, systems, and methods have been created to aid in the correct timing for the administration of medications to patients. However the prior dosage or dosage timing and measuring devices have generally proved inconvenient, complex and are difficult to use especially by patients with multiple drugs to be taken at different time intervals. Therefore the patients tended to ignore or forget to keep their medication drug schedules and medication regime requirements. Generally, in medication dispensing devices which require activation of a timer and with a patient who takes more medications several times per day, the patient may neglect or forget to activate the timer after taking each medication. Further many times the timing devices, which a patient uses for timing medication doses, are separate from or not associated with the medicine container which held the medication, which generally increased the likelihood of the patient accidentally neglecting to accurately reset time intervals between the daily medication dosages they are supposed to take.

Further medical timing devices with clock faces and/or digital readout incorporated into the cap of medication containers were so small that they were difficult to read and did not help or guide a patient in remembering what the medication interval was from the prescription and further they did not have reader-friendly written information regarding their prescription medications with their medicine containers for easily educating themselves about the time intervals for their medications and the medications' possible side effects.

Various attempts have been made in the past to try to increase and improve compliance by patients. Most of these systems are essentially reminder systems which married alarm clocks to the medication containers to remind patients when it is time to take their medications, but these systems required the patient to remember to reset the alarm for a new time interval and then take there medications and often times patients would forget to reset the timer at the time of taking their medication which led to taking the medication at improper intervals and caused under doses and or over doses.

Also attempts have been made to increase and improve compliance by patients, by providing drug information sheets which accompany the medication container so drug information sheets can be readily available when needed or when questions arise concerning the dosage and any side effects which may be a byproduct of the drugs being taken or any interference side effects caused by drug interactions of the medications the patient is taking. Currently only elemental prescription information such as patient's name, doctor, medicine name and the number of refills etc. is affixed to the medicine bottles. Other critical pharmaceutical drug information is omitted from the bottle and instead is printed by pharmacists and placed in a paper bag, which is stapled to the external side of the package when the drugs are purchased. Patients typically take out the prescription bottle with the medication then stack or store the drug instructions sheets and throw away the bag. In many instances the medicine instruction sheets are thrown away still stapled to the bag, putting patients at risk without accessible medication instructions that could save their lives. Thus storing and retrieving readable and comprehensible pharmaceutical information sheets and preventing patients from losing them, has long been a challenge for patients, pharmacies, and drug makers in the US and around the world. This problem is caused by the fact that all medicine information cannot be affixed to the surface of a bottle due to lack of surface space and even when Consumer Medication Information (CMI) documents are externally stored in medicine cabinets the physical stack, store, and retrieval of the multiple medication instruction documents become too confusing for patients, since it still separates the medications' sheets from the medicines. As a result, there exists a pressing need to eliminate or diminish the risk of losing these critical drug information sheets due to separation from medicine containers. More clearly, a need exists to have easy and prompt retrieval of CMI, without having to identify which CMI leaflets go with which medication and which bottle without having to significantly alter patients' behaviors or the current pharmacy's CMI systems.

The prior art attempted to solve this problem by providing retractable ribbon coils of CMI information in a container which allowed the patient to pull out the medical instructions to be read and then recoil them back into the container, but this re-coilable ribbon container was expensive and required special equipment for printing the ribbon with the required CMI information for each medication. Further the prior art attempted to create exotic bottles with enhanced surface and compartments for labeling which provided all the CMI information but the print was so small and the compartments so complicated in the use of the attached CMI information that a patient was not likely to be able to use the container containing the CMI information in any meaningful way.

Finally there has not been provided a comprehensive system to combine relatively standardized medication containers with means for advising patients of the time when their medication are due to be taken and not taken and which also provides the Complete CMI and FDA required information in a readable form and also allowed all the medications a person is taking to be removable and clipped together into a single arranged cluster for ease of taking and orderly arranging of the medications to be taken, eliminating confusion by the patient and/or the caregiver of a patient. Thereby increasing the effectiveness of medication compliance while reducing drug unintentional illnesses, and helping prevent fatal overdoses.

3. Objects of the Invention

It is an object of this invention to provide a medicine container system for informing a patient when it is time to take and not to take medication and for storing information sheets about the medicine and holding said medicine container or containers in an arranged cluster for the purpose of providing controlled dosage taking of medications which will decrease patient mortality risk and increase their years of healthy living by strengthening patient's medication safety while facilitating drug information and safety compliance for the patient.

It is also an object of this invention to provide a medicine container which looks like a conventional medicine container and is operationally similar to a regular medicine container, but has an electrical circuit having a timing device which can be set for a predetermined elapsed time and provides a continuous signal during the running of the predetermined time until the predetermined time runs out and then provides a different signal when the predetermined time has lapsed until being reset to zero time upon breaking said electrical circuit and restarting the timing device again on closing the circuit for measuring another predetermined elapsed time.

In this invention it is an object to select a predetermined time, like those used to separate medication intake schedules, such as one time per day, two times per day, three times per day or etc. and set the predetermined time to be used. The medication is put in the bottle and the cap is screwed on for delivery of the medication to a patient. The patient then opens the container or bottle by removing the cap to take their medication which then activates the timing device which starts a continuous signal, such as a colored light being lit, like a red one, which is continuously lit while the predetermined time is being run out. This red light is lit as long as the predetermined time, for example, two times a day has been selected, or a twelve hour predetermined time period per day has been selected. While this red light is lit a patient would be alerted that it is not time to take the medication again, but when the predetermined time period has run the red light is shut off and a signal, such as a different colored light is lit, like a green one, which is continuously lit until the patient takes the cap off to take another medication which switches off the green light and when the patient screws the cap back on the medicine bottle the red light is switched back on and a new predetermined time starts to run with the alerting red light lit all during the elapsing of the predetermined time. Thus a patient always knows not to take a medication when the red light is on and to take a medication immediately if the green light is on.

It is also an object of this invention moreover, to provide a speaker which makes an audible sound when the green light comes on or is configured to make an array of signals when the green light comes on to alert the patient that it is time to take a medication. Thus in this embodiment, not only is there a visual signal given but audible sound is generated to alert the patient that it is time to take his medication. This is very important because it does not rely on the green visual signal alone in order to alert the patient that the predetermined elapsed time has passed and that it is time to take the medication again, but alerts the patient by issuing a sound for the patient to hear from afar.

It is further an object of this invention to have a manual switch in the cap to allow the patient to switch on the system when the medicine bottle or container is brought home from the pharmacy. Thus a patient at the time of taking the first pill can switch on the system, which was off, but after switching on the system and returning cap to the container the system immediately starts to run a new predetermined time with the red light lit until the predetermined time has elapsed and the green light is then lit as a signal of time to take the next medication and/or in conjunction with an audible sound such as a buzzer from the speaker also indicating it is time to take the medication.

Yet another object of this invention is to have an easy switch for setting the elapsed time settings by having a slide switch with the medication's elapsed times on it so that the switch can be adjusted easily from one medication time setting to another either at the pharmacy or by the patient without having to have multiple different caps with prebuilt elapsed time settings for each particular medication.

Also an object of this invention is to use a cap which is substantially like those of the caps commonly used on prescription bottles today yet the cap provides a circuit means to break the circuit on removal and close the circuit on the reattachment to a medicine container. This is achieved by providing a switch in the cap which works in conjunction with the outside surface of the upper part of the medicine container which gradually engages the switch in the cap with an inclined surface that forces the switch back into engagement with the circuit for the circuit to be completed and the first signal of, for example, the red light is lit for starting the predetermined time indicated.

It is yet a further object of this invention to provide a light blocking member positioned between the light used for signals and the medication in the bottle such that the light from the LED is not transmitted through to the medication which could cause degradation or damage of the medication by the light waves. In the case of LED being in the cap this blocking member is positioned on the inside cover, but has the on-off switch, the manual slide switch for adjusting the predetermined times exposed for easy manual adjustment of the slide switch and for turning the manual switch on and off. In the case of the LED being in the lower part of the container the light blocking member is positioned between the bottom of the medicine containing chamber and the light emitting LED to block the medication from being damaged by the light waves.

In at least some embodiments, it is the object of the invention to have an inexpensive cap for the closure of the medication container and to have a manually operated switch which is a cap on the other end of the container which is brought into engagement by screwing the cap onto the container which forces all the electric circuits and battery components to be brought into connection with each other for activating the timer for a predetermined elapsed time. Once the predetermined elapsed time has run, the medication is taken by screwing off the cap which is used for closure of the medication container compartment and the medication container compartments is closed and then the cap on the other end of the container is unscrewed to break the circuits and re-screwed to engage the circuits again and initiate a predetermined time and a signal for lighting the LED for the predetermined time to elapse.

It is also an object of this invention to have a compartment in or proximate to the medicine container for the storage of medical data about the medications enclosed. This compartment in some applications of this invention are either enfolded into the medication compartment from the closed bottom of the medicine compartment and are configured for receiving a cap for providing closure of the container for storage of the medical information or are provided by having a compartment below the medicine containing chamber with a cap for securing the medical data.

It is also an object of this invention to have a rack or hub which can hold medicine containers in an arranged cluster of medicines for a patient and dispense the individual medicines and close the medicine container for setting the predetermined time by resetting the individual elapsed time for each bottle just by opening and closing the medicine bottles as the medication is being distributed. These racks or hubs may have clamp members which hold the medicine bottles and in some embodiments these clamp members have positioned between the clamp member and the hub, a fender pocket, which is provided with a cavity for storing medical information. The fender pocket is located proximate to and partially wraps around the medicine bottle it is associated with so that a patient can relate the medical data being held with the particular medication in the bottle.

Yet in further embodiments the clamp members are formed as C-clamps which extend out from the hub to releasable hold the medicine containers as an arranged cluster. In some of these embodiments there are provided grooves on the medicine bottles for receiving the arms of the C-clamps for holding the medicine containers. In some embodiments the bottles may have more than one set of grooves, such as two sets of grooves, which allows container hubs to be joined with each other by removably clamping different medicine bottles from different hubs with medicine bottles for clustering more medicine bottles and hubs together.

Further objects and advantages of the invention will be developed and expanded in the following portions of the specification wherein the detailed description is given for disclosed preferred embodiments of the invention without placing limitations on the scope of the invention.

BRIEF DESCRIPTION OF THE DRAWINGS

The invention is herein described, by way of example only with reference to the accompanying drawings wherein the detailed descriptions are for the purpose of fully disclosing preferred embodiments of the invention without placing limitations thereon.

DETAILED DESCRIPTION OF PREFERRED EMBODIMENTS

Figure 12:
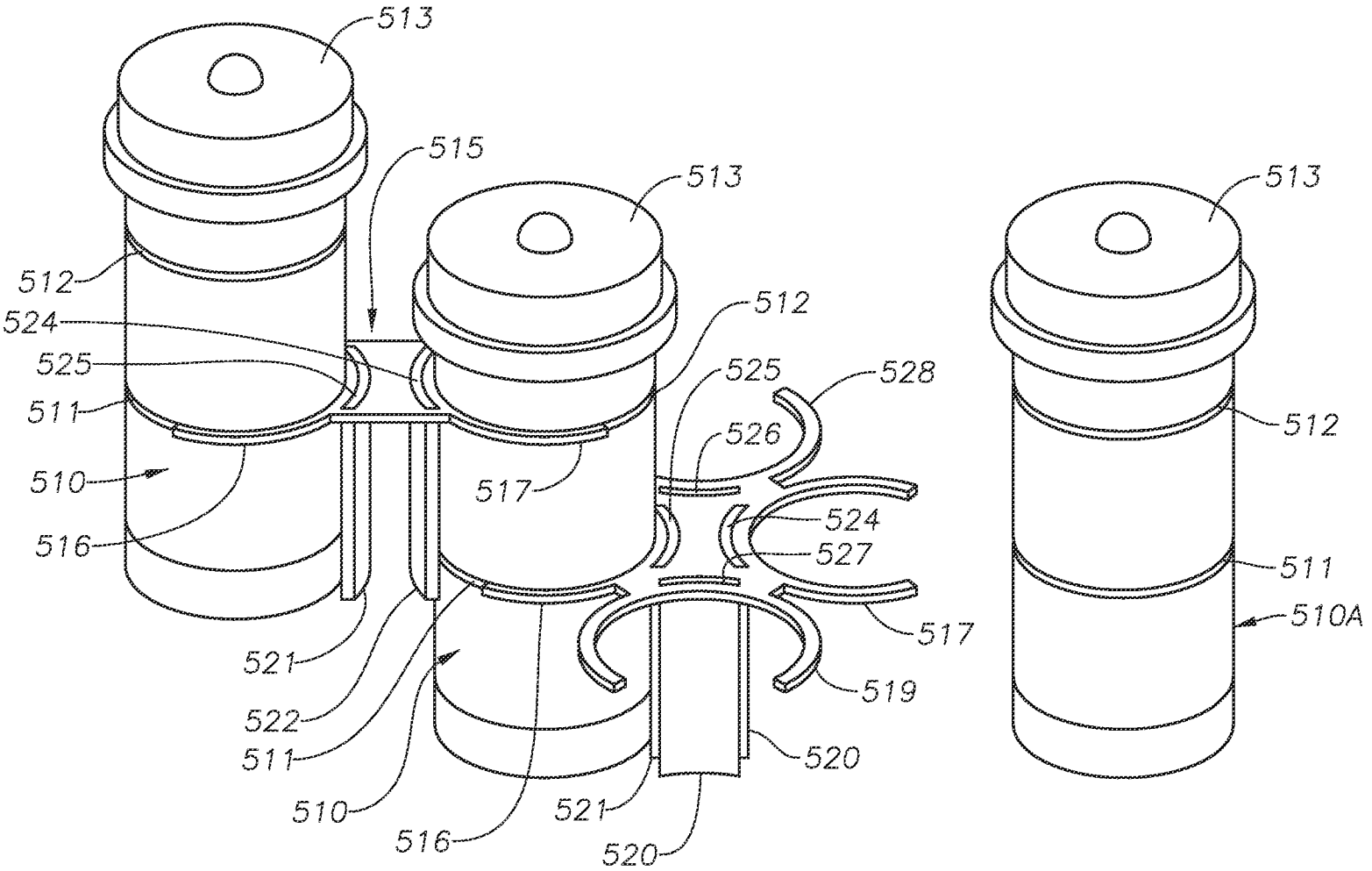
FIG. 12 is a perspective view of a pair of three C-shaped clamping members projecting from their respective hub member for gripping medicine containers of the medicine container system and releasably holding them in an arranged cluster and providing fender pockets proximate to the medicine containers for which the medical information applies for storage of the medical information and shows how they can be used to aggregate medicine containers of the medicine container system of this invention into clusters of medicine containers of the same day-part or schedule.

Referring to FIGS. 1-4 and FIGS. 5A and 5B in combination, a reference is made to one embodiment of the medicine container system with general reference to medicine container 10, the first part to be described, is shown which has at least two compartments one for medication 11 and one for storage of medical information 12. Each of the two compartments the one for medication 11 and the one for storage of medical information 12 are separated by a common wall 15 which may take many forms as will be discussed further in the specification. They also have a medicine cap 13 and a storage cap 14 used for medical information storage. The medicine container 10 and its two caps, medicine cap 13 and medical storage information cap 14 when placed on the medicine container 10 may be removal held by hub 16 which has at least two C-shaped clamping members 17 and 18 which project from the hub 16 for releasable gripping medicine containers 10 and holding them to form an arranged cluster of one or more medicine containers 10, as shown in FIG. 12. In some embodiments the container 10 may have first and second grooves 19 and 20 to facilitate the clamping of the medicine container 10 and position the C-shaped clamping members 17 and 18 in predetermined locations on the medicine containers 10.

The hub 16 is provided with fender pockets 21 and 22 which curve around the medicine containers 10 to which the C-shaped clamp member 17 or 18 are clamped and provide for storage in the fender pockets 21 and 22 of medical information associated with the medicine container or containers 10 to which the medical information applies. Access to these fender pockets 21 and 22 are achieved through slotted openings 23 and 24 which are on the surface 25 of the hub member 16 and are proximate to the containers 10 which are clamped by the respective C-shaped clamp member 17 or 18. Thus additional medical information can be folded and inserted through the slotted openings 23 and 24 into the fender pockets 21 and 22 for storage with the medicine in the medicine container 10 in addition to that stored in the compartments 12 for storage of medical information. It should also be realized that a hub 16 could be used without any fender pockets 21 and 22, but just with a hub 16 and C-shaped clamp member 17 and 18 for clamping containers 10 into an arranged cluster.

Figure 1:
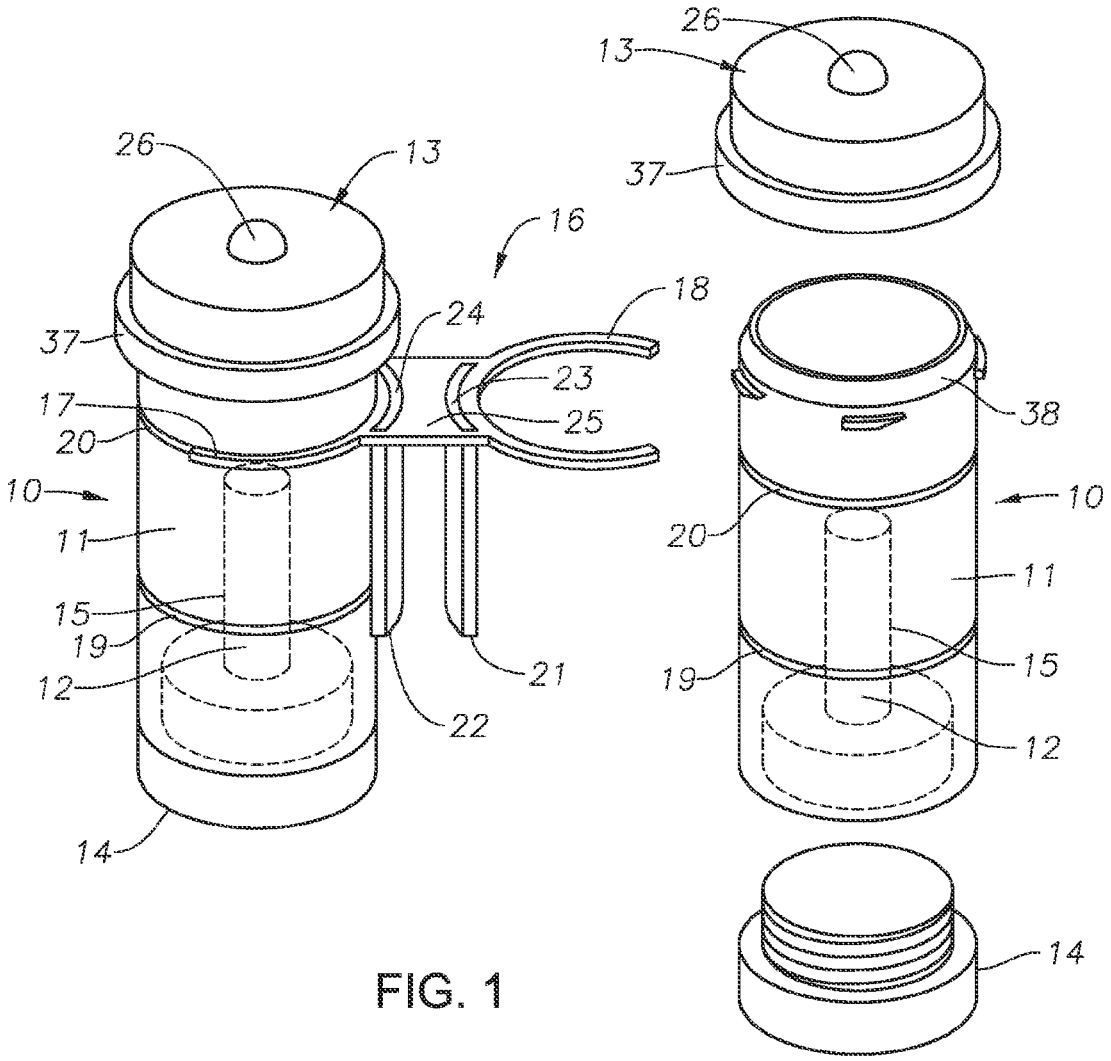
FIG. 1 is a perspective view of one embodiment of the medicine container system showing one container in closed position and located in a gripping member which is formed in a hub and another container in an opened position and located proximate to another gripping member in the hub with both containers having one compartment for providing for the storage of medication and another compartment for providing storage of medical information.
Figure 2:
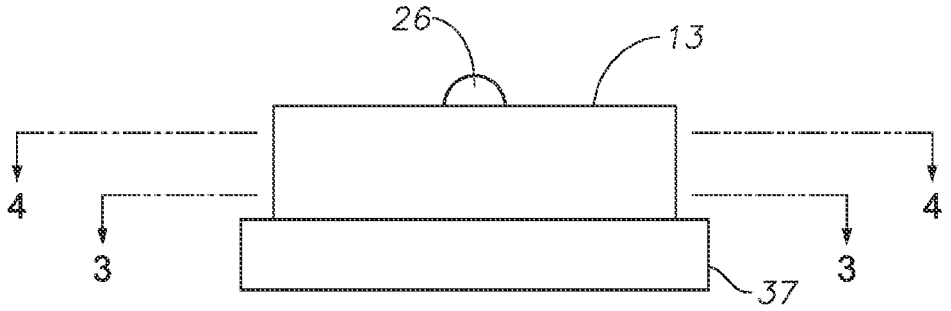
FIG. 2 is a side view of one of the caps which fit on the containers of the medicine container system which shows cross-section lines taken through the cap at the positions 4-4 and 3-3 and which show the cap and LED light located on the top center and the cap rim.

Medicine cap 13, as shown in FIGS. 1 and 2, shows an LED, light emitting diode 26, positioned in the center of the medicine cap 13 which is visible from all directions around the medicine container 10. The actuation and functioning of this LED 26 in the cap 13 which is secured to the container 10 will be described further in the specification.

The compartment 12 for storage of medical information in the embodiments of FIGS. 1 and 2 has a common wall 15 between the two compartments, the one for medication 11 and the one for storage of medical information 12 which is configured as a inverted tube which projects into the compartment for medication 11 and provides additional space for the storage of medical information in the compartment 12 for storage of medical information. As will be discussed further in the specification, the compartment 12 for the storage of medical information can take many forms without departing from the scope of this invention.

Figure 3:
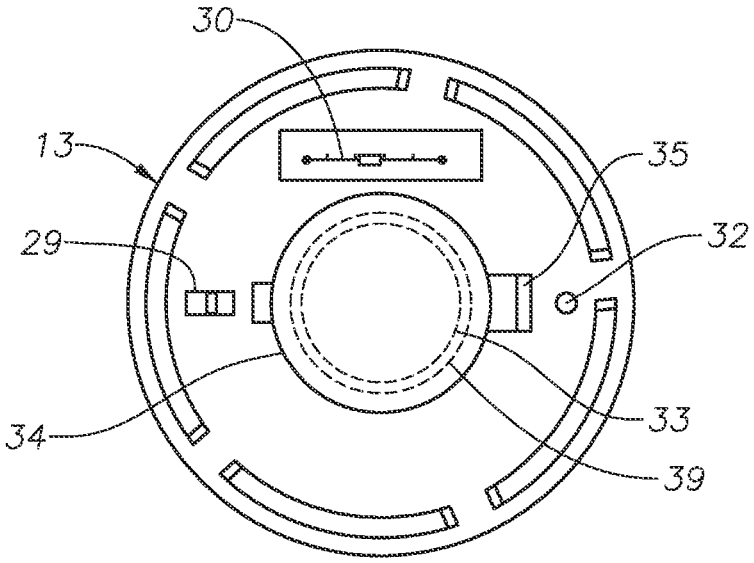
FIG. 3 is a cross-section taken through the cap at 3-3 in FIG. 2 showing the manual power on and off switch, the manual time reset button, the time slide selector, and battery cover with the battery shown in hidden lines in the electrical circuit which acts as a filter to block out the LED light, which is not shown and the lid grips for securing the cap to the medicine container.
Figure 4:
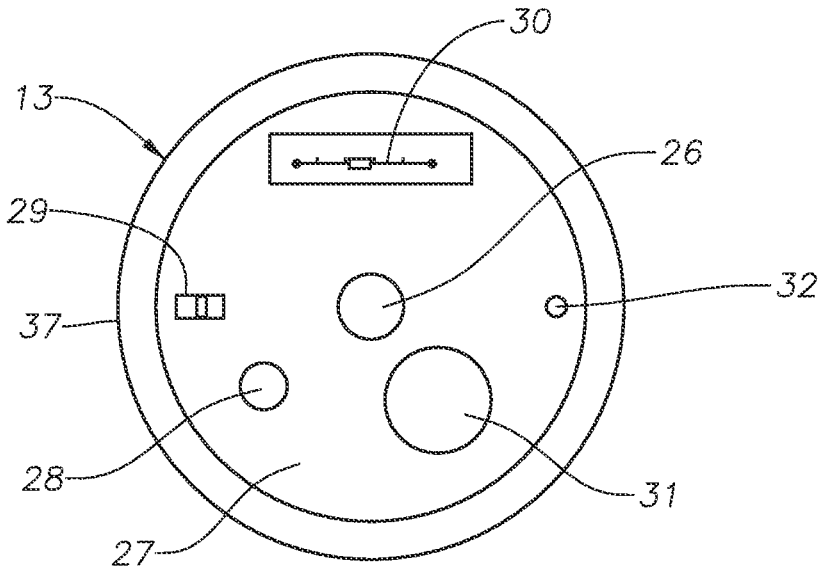
FIG. 4 is a cross-sectional view taken through the cap at 4-4 in FIG. 2 showing the manual time reset button, the speaker, the time slide selector, the LED, the timer, the manual power on and off switch and the circuit board.
Figure 5B:
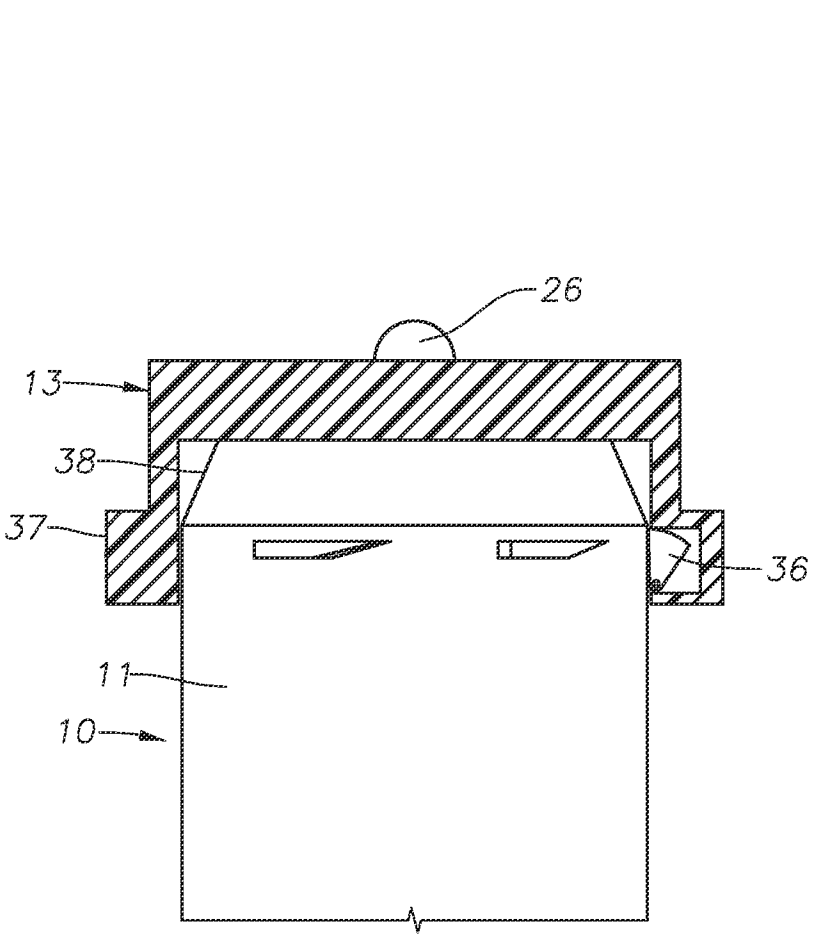
FIG. 5B is a side view of the top of the medicine container and the cap in cross-section which shows the movable switch in closed position and held in closed position as long as the cap is secured to one of the containers for providing closure of the container compartment used for medication and the cap grips for securing the cap.
Figure 5A:
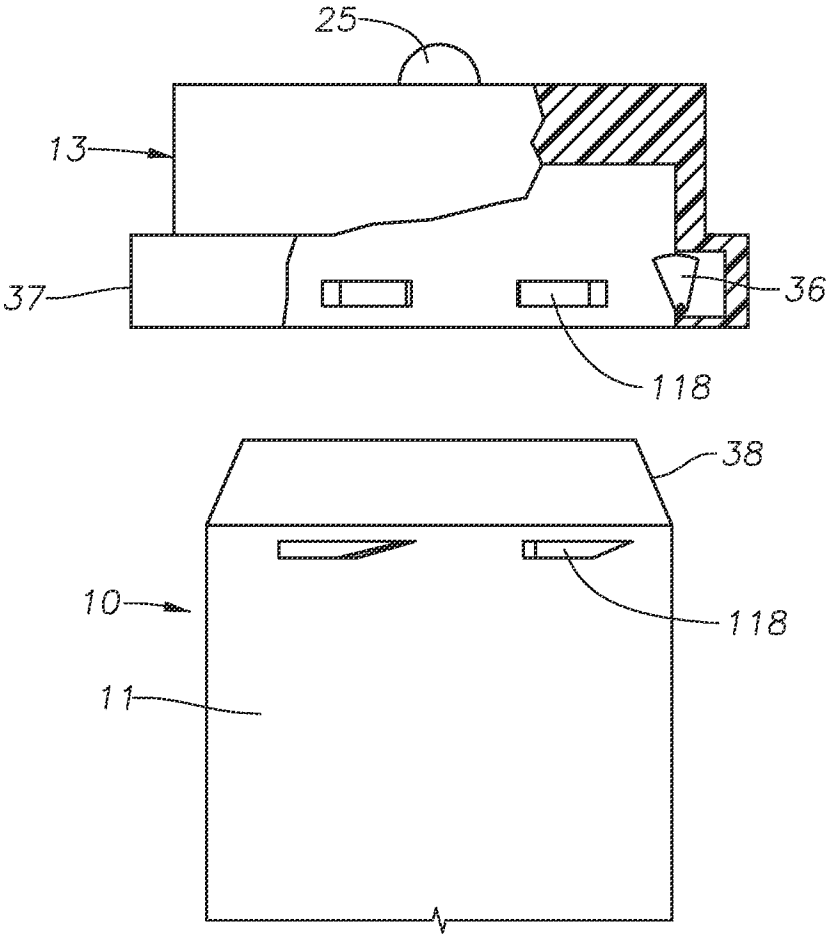
FIG. 5A is a side view of the top of the medicine container and the cap in partial cross-section which shows the movable switch in open position but which is activated to closed position as the cap fits on one of the containers for providing closure of the container compartment used for medication and the cap grips for securing the cap to the medicine container.

The medicine container system of this invention is designed with the goal of informing a patient when it is time to take and not to take medication and for storing information sheets about the medicine with the medicine containers and holding the medicine container or containers in an arranged cluster to assist patients in preventing the errors of under-dosing or overdosing on their prescription drugs caused by forgetting to take or not remembering when they last took their medications. This goal is achieved in this medicine container system by providing a continuous signal with the LED 26 through an electric circuit 27, as shown in FIG. 4, connected to the LED 26 which has a timing device 28 which can be set for predetermined elapsed time between taking of medications by a patient and then provides a continuous signal which lights the LED 26, with for example as a red light, continuously through the running of this predetermined elapsed time. Once the predetermined elapsed time has run the electric circuit 27 then provides a different signal or signals which lights the LED 26, with for example as a green light, as one of the signals, and continues to provide the green light signal until the electric circuit 27 is broken which resets the timing device 28 to zero time and then restarts the timing device 28 again on closing the electric circuit 27 to measure another predetermined elapsed time. As a second signal in some embodiments, in addition to the LED 26 green light there is also provided a speaker 31 that issues an audible sound when it is time to take medication and this audible sound by the speaker 31 will also continue until the electric circuit 27 resets the timing device 28 and then restarts the timing device 28. The goal of measuring these time intervals must be kept simple and actuated by the patient in the simple act of opening the medicine container and closing the container after the medication is taken out of the medicine container 10. This is achieved in one embodiment of this invention by using a medicine cap 13 with electrical circuits 27 and timing device 28 located in the medicine cap 13 to interface with the medicine container 10 when the cap 13 is screwed on and off container 10. This can best be seen in FIGS. 3 and 4, showing the cross-sectional construction of the medicine cap 13 and then refer to FIGS. 5A and 5B showing the interface between medicine cap 13 and the medicine container 10 at the sloped surface 38 of top rim of the medicine container 10 at switch 36.

The medicine cap 13, in some embodiments as shown in FIG. 4, has electric circuit 27 mounted as a circular board and will fit inside the Medicine cap 13 and has connected to electric circuit 27, as shown in FIG. 4, the LED 26, the timing device 28, a manual power on and off switch 29, time slide selector 30, speaker 31, and manual time reset button 32. The electric circuit 27 mounted as a circular board however has an additional function of blocking the light from the LED 26 from reaching the medication which is stored in the one compartment for medication 11 to prevent the light from damaging the medication. Also fitted into the medicine cap 13, in some embodiments as shown in FIG. 3, is a battery 33 to power the electric circuit 27 located in a battery compartment 39 which has a battery cover 34 with a finger gripper 35 for removing the battery cover 34 to replace the battery 33. The medicine cap 13 is further provided with a switch 36, as shown in FIGS. 5A and 5B, which is located in medicine cap 13 along the inside of rim 37 of the medicine cap 13 which will interface with the medicine container 10 which has a sloped upper edge surface 38 along the top of medicine container 10 which drives the switch 36 into engagement with the electrical circuit 27 when medicine cap 13 is screwed on medicine container 10 as shown FIGS. 5A and 5B which then actuates the resetting of the elapsed time and starts the LED 26 light signal indicating it is not time to take medication. This resetting of the elapsed time which starts the LED 26 emitting a light signal, such as a red light, will continue during the elapsed time from when the patient took the medication and put the medicine cap 13 back on the medicine container 10 until the elapsed time has run which would indicate it is time for the patient to take another medication. When this elapsed time has run out the electric circuit 27 switches to a different signal which starts the LED 26 emitting a light signal, such as a green light, which will continue until the patient opens the medicine container 10 by removing the medicine cap 13 to take his medication. At the time the medicine cap 13 is removed from the medicine container 10, the electric circuit 27 is broken by interaction between switch 36 in medicine cap 13 and sloped surface 38 of the medicine container 10 which then resets the timing device 28 to the predetermined elapsed time used for the time between the taking a medication by patient. However once the patient puts the medicine cap 13 back on the medicine container 10 the electric circuit 27 is reconnect by the interaction of switch 36 and sloped surface 38 of the upper edge medicine container 10 with medicine cap 13 which then issues a new signal which causes the LED 26 to issue a red light signal to not take a medication starting the cycle over again.

How all these parts interact to provide information to a patient on when it is time to take and not take medication can best be understood by providing examples of use of the parts in an example of one routine of a patient taking medication, and/or purchasing medication and beginning to take the medication. A pharmacist would fill the prescription and put the medication in the one compartment for medication 11 and insert the medical information for the medication into stored information compartment 12. The pharmacist would then determine the proper time intervals for the taking of the medication and take the medicine cap 13 turn it over and move the time slide selector 30 to the proper interval (i.e. three times a day, four times a day or twice a day) or in some cases the time slide selector 30 would be set in hours stretches (i.e. 12 hours or two times a day) in a 24-hour period. It should be understood that the time slide selector 30 is connected to the timing device 28, which is set for predetermined elapsed time by the time slide selector 30. When the patient comes to the pharmacy to pick up his medication the pharmacist would flip the manual power on and off switch 29 to the on position and activate the manual time reset button 32 if the patient took the first dose of medication when he picked it up at the pharmacy, the pharmacist would inform the patient that he or she should not take the medicine until a green light appears in LED 26 on the medicine cap 13 and/or a speaker 31 issues an audible sound after he takes medicine home indicating it is time for the patient to take the medication. Also the pharmacist may provide instructions to the patient on how to use the medicine container system. These instructions would include turning on the manual power on-off switch 29, sliding the time slide selector 30 to the correct predetermined elapsed time when needed and pointing out the location of the medicine sheets 28. Once the medicine cap 13 is screwed back on the one compartment for medication 11 on the medicine container 10 the switch 36 is depressed by the sloped surface 38 of top rim of medicine container 10 and the timing device 28 is activated which will cause the electric circuit 27 to issue a first continuous signal which in one example is the LED 26 emitting a continuous red light until the predetermined elapsed time has run out, at which time the LED light 26 will issue continuous green light and/or the speaker 31 may issue a continuous sound until the medicine cap 13 is screwed off the container 10 to take a medication which releases switch 36 and breaks the circuit for resetting the timing device 28 for another predetermined elapsed time. This predetermined elapsed time is commenced upon the screwing of the medicine cap 13 back on to compartment for medication 11 of medicine container 10 which thereby starts a another predetermined elapsed time. The essence of the instructions are therefore simply if the LED 26 shows a red light to the patient, the patient does not take the medication, but if the LED 26 shows a green light and/or issues a sound from the speaker 31 it is time to take medication and once the medicine cap 13 is removed the LED 26 green light and/or sound issued by the speaker 31 will go silent, but when the medicine cap 13 is screwed back on to the container 10 the LED 26 will show a red light.

Figure 6A:
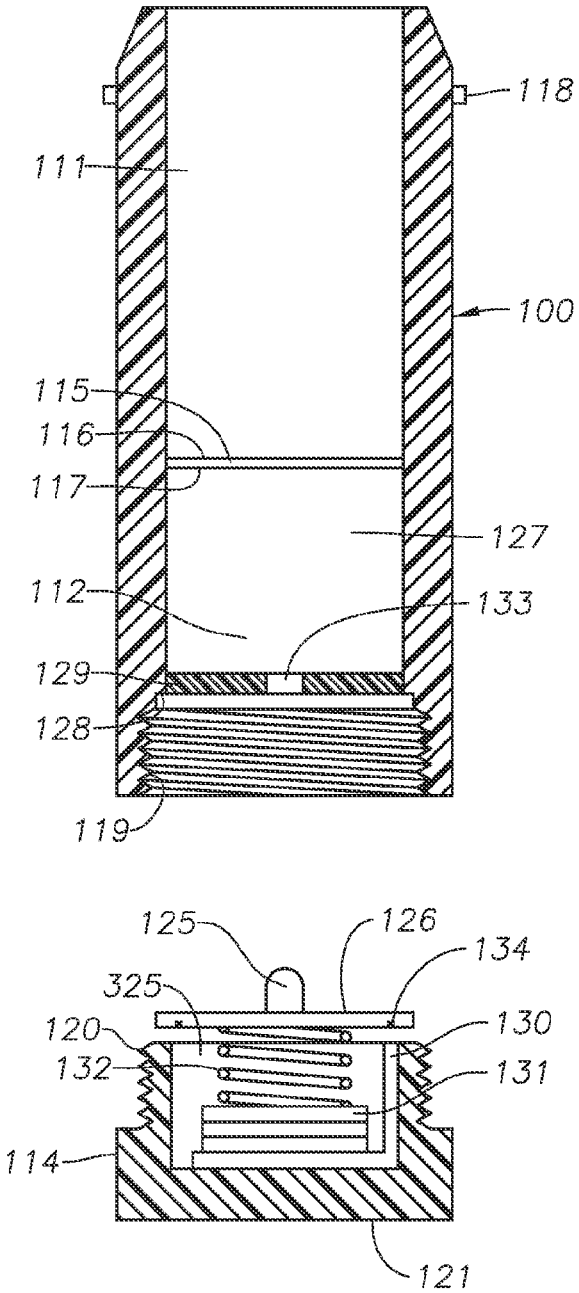
FIG. 6A is the cross-sectional view taken through the medicine container having a compartment for medication and another compartment for acting as a switch in conjunction with the retightening of the cap for providing closure of the other compartment and providing an LED lighting signal through the walls of the medicine container when in the screwed in position.
Figure 6B:
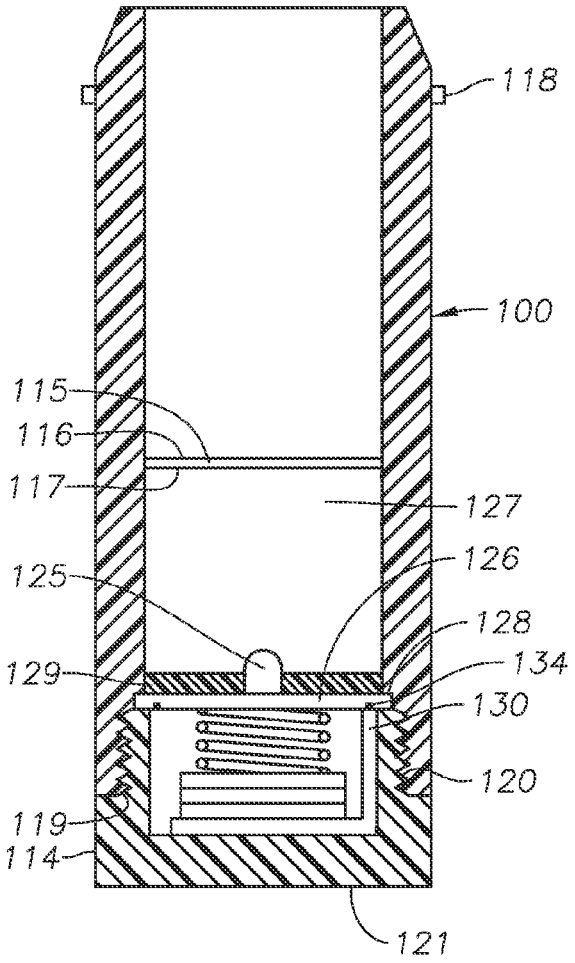
FIG. 6B is the cross-sectional view taken through the medicine container having a compartment for medication and another compartment for acting as a switch in conjunction with the untightening of the cap for providing opening of the other compartment and providing a turn off of LED lighting signal through the walls of the medicine container when in the screwed out position.

As the hub 16 can provide storage for medical information in the fender pockets 21 and 22, this provides for additional configurations of the medicine container system for informing a patient when it is time to take and not take medication. In this embodiment as shown in FIGS. 6A and 6B, the medicine container 100 has at least two compartments one for medication 111 and at least one compartment 112 for the storage of electric circuit members like those in cap 13 of FIG. 4 not shown here but which may be stored in an actuator cap 114. Also this embodiment has a common separator partition 115 which provides the bottom 116 of the one compartment for medication 111 and the top 117 of the storage of electrical circuit members 113. This common separator partition 115 also serves as a shield to block the light from being transmitted to the one compartment for medication 111 from the at least one compartment 112 for storage of electric circuits. The importance of this will be understood as further disclosed in this specification. Also this medicine container 100 has standard medicine bottle lid grips 118 on the medicine container 100 to fasten a standard medicine cap, not shown, on to the one compartment for medication 111 and it provides a recessed threaded surface 119 for receiving actuator cap 114 which is also provided with threaded surfaces 120 and forms a bottom 121 of the medicine container 100. Actuator cap 114 is fitted with an electrical circuit board 126 which has mounted to it a LED 125 which when inserted into the compartment for electrical storage circuits 112 projects into the compartment 112 for storage of electric circuits through an aperture 133 in the bottom seating surface 129 of compartment 112 for storage of electric circuits but seats against the shoulder member 128. The LED 125 thus is allowed to light the cavity 127 and that light will be transmitted through the walls of the medicine container 110 to issue a signal to a patient on taking their medicine. The shoulder member 128, as shown in FIG. 6B, forces the electrical circuit board 126 to engage positive electrical contact 134 on the electrical circuit board 126 with an electrical contact 130 on actuator cap 114 which is in connection with batteries 131 and at the same time drives the negative contact spring contact 132 into contact with the battery 131 to cause the LED 125 to be lit when the actuator cap 114 is screwed all the way in to the compartment for electrical storage circuits 112. As shown in FIG. 6A when unscrewed the LED 125 is disconnected from being lit because the negative spring contact 132 pushes the positive electrical contact 134 with the batteries 133 apart from the electrical contact 134. The importance of this making and breaking contact will be understood in light of the fact that the circuit board 126 carries a timing device, a time slide selector, a speaker and a manual reset button like in FIG. 4, but not shown in FIGS. 6A and 6B, but which in combination can provide a means for determining a predetermined elapsed time and provide a continuous signal during the running of the predetermined time until the predetermined time has run out and then provide a different signal such as a green light incident when the predetermined time has elapsed. Upon breaking the circuit by screwing the actuator cap 114 out from the compartment for electrical circuit storage 112 breaks the circuit and upon the reinsertion of the actuator cap 114 restarts the timing device again for measuring another predetermined elapsed time. Thus in this embodiment a time for taking a medicine and a time not to take medication is alternated between those cycles by manually unscrewing the actuator cap 114 and screwing the actuator cap 114 back in when a medicine is taken from the medicine storage compartment 111.

Figure 7:
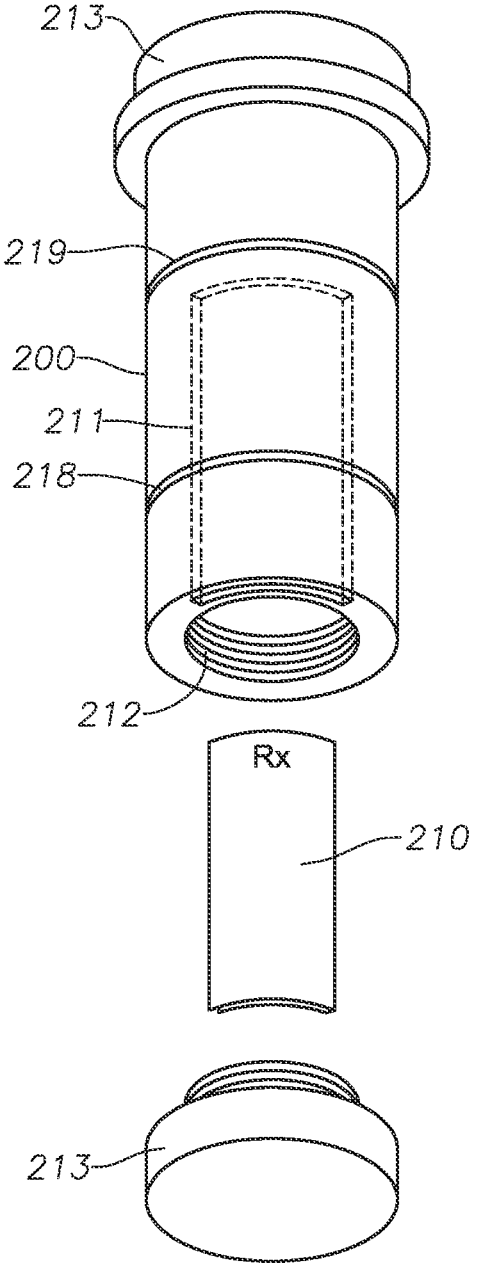
FIG. 7 is a perspective view of one embodiment of the medicine container system showing one container in closed position for providing for the storage of medication and another compartment for providing storage of medical information located in a compartment which is formed in the side wall of the container for storage of medicine information and is closed by cap from the bottom.
Figure 8:
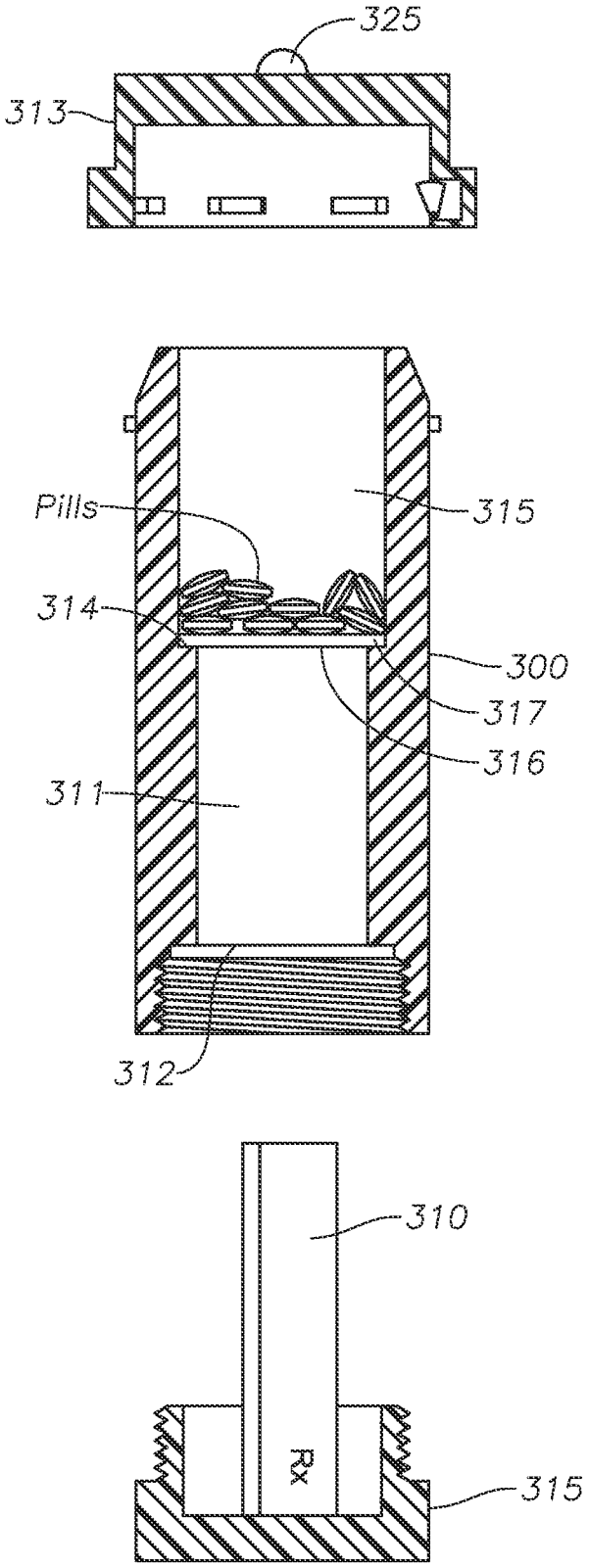
FIG. 8 is a cross-section view of one embodiment of the medicine container system showing one container in open position for receiving medication for the storage of medication and another compartment for providing storage of medical information located in another compartment of the container for storage of medicine information and is shown in open position with the cap removed.
Figure 9:
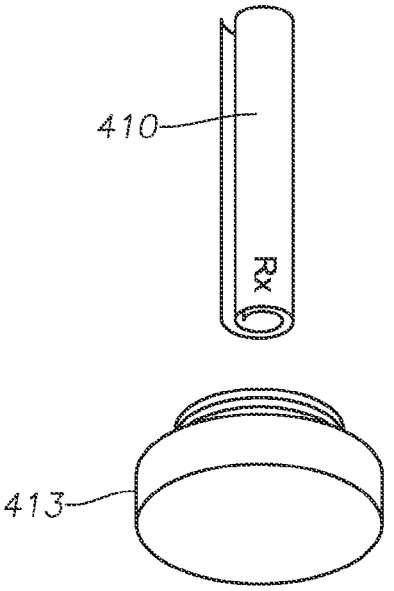
FIG. 9 is a perspective view of one embodiment of the medicine container system showing one container in open position for receiving medication for the storage of medication and another compartment which is a closed smaller elongated tube extending upward from the closed bottom end of the container for medication but is opened on the bottom for receiving medical information, as shown, for storage and for receiving a cap for providing storage of medical information, but as shown, in open position with the cap removed.

In yet other embodiments such as those shown in FIGS. 7-9, there are other embodiments of storage for medication information in the medicine containers without departing from the scope of this invention. For example, in FIG. 7 the medical information or prescription information 210 is stored in a curved side wall pocket 218 which has an opening in the bottom 212 of the medicine container 200. Medicine container 200 also has medicine cap 213 which is provided with electrical circuits like cap 13 as in FIGS. 1-4 and FIGS. 5A-5B for lighting the LED but is not shown in this figure. The bottom of the medicine container 200 is closed by a simple screw cap 213, but a bottom is also provided for the medicine compartment which is not shown. Grooves 218 and 219 are provided to allow removable insertion of the medicine containers 200 into C-shaped clamp members 17 and 18 on hubs 16 as disclosed in FIG. 1.

In yet other embodiments as shown in FIG. 8 the medical information or prescription information 310 stored in an open compartment for medical information 311 which has an opening in the bottom 312 of the medicine container 300. Medicine container 300 also has a medicine cap 313 which is like cap 13 provided with electrical circuits as in FIGS. 1-4, 5A and 6B. for lighting the LED 325. The bottom of the medicine container 300 is closed by a simple screw cap 315. The bottom 314 to the medicine compartment 300 is provided with partition 317 midway between the top and bottom of the medicine container 300 as shown in FIG. 8 and which also provides the top 316 of the container compartment for medication information storage.

In yet another embodiment as shown in FIG. 9 the medical information or prescription information 410 is stored in an inverted tube 411 which has an opening in the bottom 412 of the medicine container 400. The medicine container 400 also has a medicine cap, not shown but which is like cap 13 as provided with electrical circuits as in FIGS. 1-4 and FIGS. 5A and 5B for lighting the LED not shown. The bottom of the medicine container 400 is closed by a simple screw cap 413, which also forms closure for the inverted tube 411.

Figure 10:
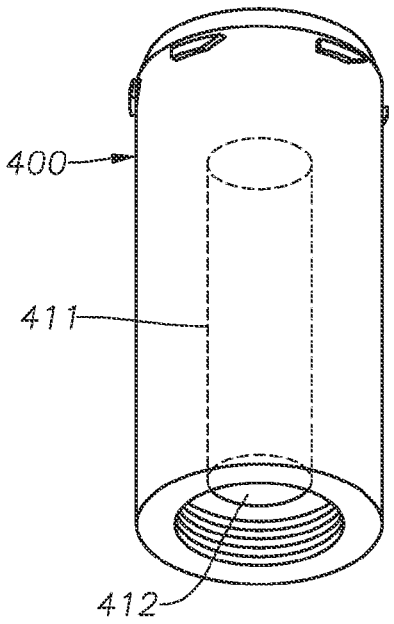
FIG. 10 is a perspective view of at least two C-shaped clamping members projecting from a hub member for gripping medicine containers of the medicine container system and releasably holding them in an arranged cluster and providing fender pockets proximate to the medicine containers for which the medical information applies for storage of the medical information.
Figure 10:
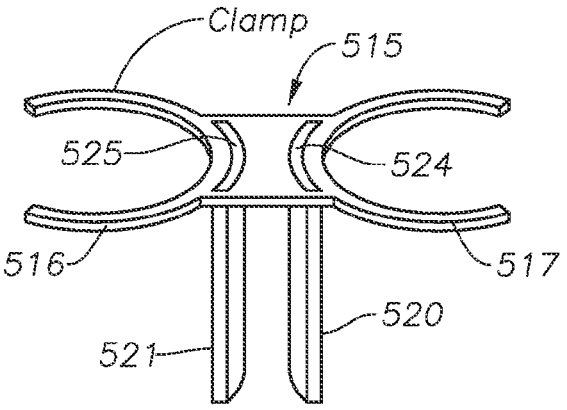
Figure 11:
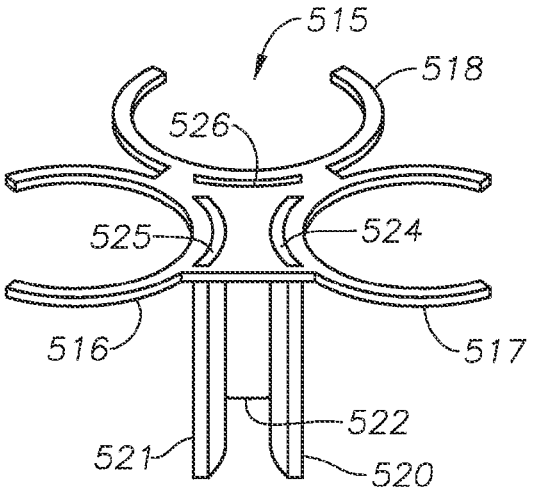
FIG. 11 is a perspective view of three C-shaped clamping members projecting from a hub member for gripping medicine containers of the medicine container system and releasably holding them in an arranged cluster and providing fender pockets proximate to the medicine containers for which the medical information applies for storage of the medical information.

Referring to FIGS. 10-12, it should be understood that the hub 515 which has at least two C-shaped clamping members 516 and 517 may be used to form an aggregation of medicine containers 510, as in FIG. 12. These containers 510 have at least two grooves 511 and 512 as shown in FIGS. 10-12 having C-shaped clamping members 516 and 517 projecting from hub 515, but may also have a third C-shaped clamping member 518 as shown in FIG. 11 or a fourth C-shaped clamping member 519 as shown in FIG. 12 projecting from the hub 515 to allow multiple aggregation of medicine containers 510. These containers could also have medical caps 513 which are like caps 13 of those shown in FIGS. 1-4, FIGS. 5A-5B, and FIG. 6B provided for medicine containers 510 to allow a patient taking multiple medications to arrange their multiple medications into a medicine container system for informing a patient when it is time to take and not take each of these medications even if they are required to be taken at different times and for storing information sheets about the medication with the medicine container 510 in a cluster of hubs 515 using the at least two grooves 511 and 512 of medicine containers 510 by attaching one of the C-shaped clamping members 516 of hub 515 to medicine container 510 and by attaching the other C-shaped clamping member 517 to the other of the grooves 511 at another location on the medicine container 510 as shown in FIG. 12. A patient could continue to add medicine containers 510 to the hub 516 until all his medications were collected in an arranged time based cluster. Each of these medicine containers 510 have storage for the medical information and also additional storage for the medical information could be provided in fender pockets 520, 521, 522, and 523 which are provided on the slotted openings 524, 525, 526, and 527 of the surface of hub 515.

That claimed is:

1. A medicine container system for informing a patient when it is time to take and not to take medication and for storing information sheets about the medicine and holding said medicine container or containers in an arranged cluster comprising;

a. an electrical circuit means having a timing device which can be set for a predetermined elapsed time and provides a continuous signal during the running of said predetermined time until said predetermined time runs out and then provides a different signal when said predetermined time has lapsed until being reset to zero time upon breaking said electrical circuit and restarting said timing device again on closing said circuit for measuring another predetermined elapsed time, b. a battery for powering said electrical circuit, c. a container having at least two compartments one for medication and at least one for an electrical circuit means having a timing device which can be set for a predetermined elapsed time and provides a continuous signal during the running of said predetermined time until said predetermined time runs out and then provides a different signal when said predetermined time has lapsed until being reset to zero time upon breaking said electrical circuit and restarting said timing device again on closing said circuit for measuring another predetermined elapsed time, d. at least one cap which fits on said one of said container compartments for providing closure of said container compartments with medication, e. at least one cap which fits on said other of said at least two compartments for acting as a switch for activating said timing devise off and on when said at least one cap is untightened and retightened for providing closure of said at least other of said at least two compartments, f. at least one gripping means formed in a hub for removably attaching to said container or containers for being able to form an aggregation of said medicine containers into an arranged cluster of medicine containers when additional medicine containers are added to said gripping means formed in said hub, and g. fender pocket means with pockets for providing storage cavities for holding said medical information are provided between said gripping means and said hub for holding medicine information for each container.

2. The medicine container system of claim 1 wherein said electrical circuit means having a tinting device provided for measuring elapsed time and providing a signal during the running of said predetermined elapsed time further comprises;

a. a first light for being lit as said signal during the running of said predetermined time for measuring said elapsed time, and b. a second light for being lit as said signal after running of said predetermined time for measuring elapsed time has run until being reset to zero time upon breaking said electrical circuit and restarting said timing device again on closing said circuit for measuring another predetermined elapsed time with said first light as said signal.

3. The medicine container system of claim 2 further comprising;

a. a means positioned between the lights for being lit and said medication for shielding said medication from said light for preventing damage by said light to said medication.

4. The medicine container system of claim 3 wherein said signal provided after the running of said predetermined time for measuring elapsed time until being reset to zero time upon breaking said electrical circuit and restarting said timing device again on dosing said circuit for measuring another predetermined elapsed time with said first light as said signal further comprises;

a. a speaker for making an audible sound as said signal after the running of said predetermined time for measuring elapsed time until being reset to zero time again upon breaking said electrical circuit and restarting said timing device again on closing said circuit for measuring another predetermined elapsed time with said first light as said signal.

5. The medicine container system of claim 4 wherein said first light for being lit as said signal during the running of said predetermined time for measuring said elapsed time, and said second light for being lit as said signal after running of said predetermined time for measuring elapsed time has run until being reset to zero time upon breaking said electrical circuit and restarting said timing device again on closing said circuit for measuring another predetermined elapsed time with said first light as said signal further comprises, a. a colored light as said first light, and b. a different colored light from said first colored light as said second light.

6. The medicine container system of claim 5 wherein said holding of said medicine container or containers in an arranged cluster further comprises;

a. a hub member, and b. clamping members projecting from said hub member for gripping said medicine. containers and releasably holding them to form an arranged cluster of one or more medicine containers.

7. The medicine container system of claim 6 wherein said holding of said medicine container or containers in an arranged cluster further comprises;

a. a fender pocket means connected to said hub member proximate said clamping members for gripping said medicine containers and releasably holding them for providing storage cavities in said fender pocket means for medical information to be stored therein proximate said medicine container for which said medical information applies.

8. The medicine container system of claim 7 wherein said Clamping members projecting from said hub member for gripping said medicine containers and releasably holding them to form an arranged cluster of one or more medicine containers further comprises;

a. a first C-shaped clamping member for gripping said medicine container and releasably holding them, and b. at least a second C-shaped clamping member for gripping said medicine container or containers and releasably holding them for providing a stable arranged cluster of one or more medicine containers.

9. The medicine container system of claim 8 wherein said container having at least two compartments one for medication and at least one for article information storage further comprises:

a. a first groove on said container formed for engagement with said first clamping member from said hub member for positioning said clamping member and said container in a predetermined relationship on said hub member, and b. a second groove on said container formed for engagement with said second clamping member from said hub member or an additional hub member for positioning and said clamping member and said container in a predetermined relationship on said hub member or said additional hub member and providing stable alignment of said container with said clamping members on said hub member or said additional hub member.

* * * * *